US009279434B2

(12) United States Patent
Ehrhardt et al.

(10) Patent No.: US 9,279,434 B2
(45) Date of Patent: Mar. 8, 2016

(54) PRESSURE MEDIUM SYSTEM, IN PARTICULAR HYDRAULIC SYSTEM

(75) Inventors: Winfried Ehrhardt, Laubach (DE); Georg Westerhagen, Nidda (DE)

(73) Assignee: Ludwig Ehrhardt GmbH, Laubach (DE)

( * ) Notice: Subject to any disclaimer, the term of this patent is extended or adjusted under 35 U.S.C. 154(b) by 307 days.

(21) Appl. No.: 14/128,173

(22) PCT Filed: Jun. 20, 2012

(86) PCT No.: PCT/EP2012/002598
§ 371 (c)(1),
(2), (4) Date: Dec. 20, 2013

(87) PCT Pub. No.: WO2013/000549
PCT Pub. Date: Jan. 3, 2013

(65) Prior Publication Data

US 2014/0130484 A1 May 15, 2014

(30) Foreign Application Priority Data

Jun. 27, 2011 (DE) ..... 10 2011 105 584
Sep. 5, 2011 (DE) ..... 10 2011 112 701

(51) Int. Cl.
*F15B 21/08* (2006.01)

(52) U.S. Cl.
CPC ..... *F15B 21/08* (2013.01); *F15B 2211/20546* (2013.01); *F15B 2211/251* (2013.01); *F15B 2211/26* (2013.01)

(58) Field of Classification Search
CPC ..... F15B 21/08; F15B 21/087; F15B 2211/20538
USPC ..... 60/431, 452
See application file for complete search history.

(56) References Cited

U.S. PATENT DOCUMENTS 4,842,244 A * 6/1989 Panchison, Jr. ..... F16K 31/1635 251/26
5,317,870 A * 6/1994 Inagawa ..... B60T 8/4009 60/418

(Continued)

FOREIGN PATENT DOCUMENTS

| | | |
|---|---|---|
| DE | 3136177 | 3/1983 |
| DE | 69715709 | 10/1997 |
| DE | 19713576 | 10/1998 |
| DE | 19959706 | 6/2001 |
| DE | 102005002443 | 7/2006 |
| DE | 102005060321 | 6/2007 |
| DE | 202008011507 | 2/2010 |

OTHER PUBLICATIONS

International Search Report for corresponding PCT Application No. PCT/EP2012/002598, dated Dec. 21, 2012.

*Primary Examiner* — Thomas E Lazo
(74) *Attorney, Agent, or Firm* — Caesar Rivise, PC

(57) ABSTRACT

The invention relates to a pressure medium system, in particular a hydraulic system, having a fluid pump for delivering a drive fluid with a certain delivery flow rate and a certain fluid pressure, and having a control unit which switches the fluid pump on or off in order to set a predefined setpoint value of the fluid pressure, wherein the fluid pump exhibits an inertia-induced overrun when switched off, such that during the overrun of the fluid pump, the fluid pressure still rises while the fluid pump has already been switched off. It is proposed that, during the increase of the fluid pressure to the predefined setpoint value, the control unit switches the fluid pump off before the fluid pressure has reached the predefined setpoint value. The invention also includes a corresponding operating method.

13 Claims, 8 Drawing Sheets

(56) References Cited

U.S. PATENT DOCUMENTS 5,669,055 A 9/1997 Thayer et al.
5,829,335 A 11/1998 Ewald et al.
6,223,530 B1 * 5/2001 Weber ..... B60P 1/4471 60/431
6,709,067 B1 * 3/2004 Schmitt ..... B60T 8/36 303/11
8,239,058 B2 * 8/2012 Hakoda ..... B29C 45/80 264/40.5
8,596,608 B2 * 12/2013 Grimseth ..... E21B 33/0355 137/12
2004/0098984 A1 * 5/2004 Duell ..... E02F 9/2235 60/431
2011/0001351 A1 * 1/2011 Grell ..... B60T 8/36 303/11

* cited by examiner

PRESSURE MEDIUM SYSTEM, IN PARTICULAR HYDRAULIC SYSTEM

CROSS-REFERENCE TO RELATED APPLICATIONS

This national stage application claims the benefit under 35 U.S.C. §371 of International Application No. PCT/EP2011/002598 filed on Jun. 20, 2012, entitled PRESSURE MEDIUM SYSTEM, IN PATRICULAT HYDRAULIC SYSTEM, which in turns takes its priority from German Patent Application No. 10 2011 112 701.5 filed Sep. 5, 2011 and German Patent Application No. 10 2011 105 584.7 filed Jun. 27, 2011, and all of whose entire disclosures are incorporated by reference herein.

FIELD OF INVENTION

The invention concerns a pressure medium system, in particular a hydraulic system of a clamping device for mechanical clamping of workpieces or workpiece holders, such as workpiece pallets.

Such clamping devices having a hydraulic system are, for example, known from DE 31 36 177 A1 and contain a hydraulic pump, a pressure sensor and a pressure-limiting valve as well as a control unit.

The hydraulic pump generates the hydraulic pressure required for operation of the clamping device, wherein the hydraulic pump can be driven, for example, by an electric motor.

The pressure-limiting valve is arranged between the hydraulic pump and the hydraulic consumer of the clamping device and leads the hydraulic oil at exceeding of a predetermined maximum value back into a hydraulic oil tank in order to limit the hydraulic pressure to the admitted maximum value.

This pressure limitation can, for example, be required when the hydraulic pump, due to a malfunction, delivers a larger volumetric flow than is necessary for maintaining a predefined target value.

Furthermore, this pressure limitation can, however, also be required when the hydraulic oil enclosed in the hydraulic system expands due to heating, which is associated with a corresponding pressure rise.

The control unit measures, by means of the pressure sensor, the hydraulic pressure generated by the hydraulic pump and switches the hydraulic pump on when the hydraulic pressure falls below a predefined minimum value (switch-on pressure). During the subsequent pressure build-up, the control unit continuously measures, by means of the pressure sensor, the actual hydraulic pressure and switches off the hydraulic pump when the hydraulic pressure measured by the pressure sensor exceeds the predefined target value (switch-off pressure). In this manner, the hydraulic pressure is maintained between the minimum value and the target value during the operation of the clamping system.

FIGS. 5A to 5D show for such a conventional hydraulic system the temporal course of the hydraulic pressure (FIG. 5A), the on/off state of the hydraulic pump (FIG. 5B), the on/off state of the consumer (FIG. 5C) and the on/off state of the pressure-limiting valve (FIG. 5D).

This known hydraulic system has different disadvantages, which are described shortly in the following.

On the one hand, part of the volumetric flow delivered by the hydraulic pump is discharged via the pressure-limiting valve when the hydraulic pressure exceeds the predefined target value. This pressure limitation is, however, associated with a corresponding dissipation power of the pressure-limiting valve.

On the other hand, the hydraulic pump is mostly operated at a high hydraulic pressure near the target value, which is associated with a correspondingly high load of the hydraulic pump and with a correspondingly high energy expenditure.

Furthermore, there is the problem that the hydraulic pump must be turned on again when the hydraulic pressure has fallen below a predefined minimum pressure. It is problematic in this case that the so-called subsequent switching of the hydraulic pump does not immediately lead to a pressure rise, which has various causes. On the one hand, the motor relay of the hydraulic pump has a certain dead time, whereby the start-up of the hydraulic pump is delayed. Beyond this, due to its mass inertia, the hydraulic pump needs a certain start-up time. On the other hand, however, the hydraulic pressure also has a time constant in the hydraulic system and rises linearly after the start-up of the hydraulic pump. This temporal delay can cause for subsequent switching of the hydraulic pump that the predefined minimum pressure is fallen short of.

DE 199 59 706 A1 and DE 10 2005 060 321 A1 reveals pressure medium systems for a motor vehicle brake system, wherein the phenomenon also occurs that a hydraulic pump does not immediately stands when switched off, but rather has an overrun. The possible pressure rise during this overrun when switching off is, however, compensated for in these documents by the fact that the control times for downstream valves is modified accordingly. In this case, the pressure rise is thus not prevented during the overrun, but rather compensated for through suitable control measures.

Reference is also made to DE 20 2008 011 507 U1, DE 697 15 709 T2 and DE 197 13 576 A1 concerning the prior art from other technical fields.

BRIEF SUMMARY OF THE INVENTION

Therefore, the invention is based on the object of creating a correspondingly improved hydraulic system, which avoids these disadvantages as far as possible.

The invention is based upon the technical insight that the fluid pump (e.g. hydraulic pump) still has an inertia-induced overrun also after the switching off of its drive, so that the fluid pressure (e.g. hydraulic pressure) still rises a little bit also after the switching-off of the fluid pump during the overrun of the fluid pump.

The invention therefore provides for that the fluid pump is already switched off during pressure build-up before the fluid pressure has reached the predefined target value. During the subsequent overrun of the fluid pump, the fluid pressure then still rises from the switch-off pressure with a certain overrun pressure rise towards the predefined target value. The invention thus exploits the kinetic energy of the fluid pump, of the drive of the fluid pump and/or of the liquid column delivered by the fluid pump.

On the one hand, this offers the advantage that the fluid pump is operated less often at high fluid pressures near the target value, whereby the fluid pump is protected and less drive energy is consumed.

On the other hand, the invention also offers the advantage that less fluid (e.g. hydraulic oil) must be discharged via the pressure-limiting valve, whereby the pressure-limiting valve is protected and less dissipation power comes up.

In a preferred specimen embodiment of the invention, the switch-off pressure is dimensioned such that the pressure difference between the predefined target value and the switch-off pressure is smaller than the overrun pressure rise.

This means that the fluid pressure after the switching-off of the fluid pump still rises at least up to the predefined target value. The overrun pressure rise should therefore be preferably large enough in order to bridge the pressure difference between the switch-off pressure and the target value.

In this case, it must be taken into consideration that the pressure rise during the overrun of the fluid pump runs asymptotically up to a final value, so that the pressure rise is continuously slower in the upper pressure range up to the final value. It is, however, generally desirable that the predefined target value of the fluid pressure is reached as fast as possible during the overrun. Preferably, the switch-off pressure is therefore dimensioned such that the overrun pressure rise exceeds the pressure difference between the switch-off pressure and the predefined target value by at least 1%, 2%, 5%, 10%, 20%, 50%, 100% or 200%. This offers the advantage that for bypassing the pressure difference between the switch-off pressure and the predefined target value, the relatively steep-running initial pressure rise during the overrun is exploited, so that the predefined target value is adjusted relatively quickly after the switching-off of the fluid pump.

On the other hand, it is not required that the fluid pressure still rises substantially after the switching-off of the fluid pump during the overrun further than up to the desired target value. The switch-off pressure is therefore preferably dimensioned such that the overrun pressure rise exceeds the pressure difference between the switch-off pressure and the predefined target value by at most 200%, 100%, 50%, 20%, 10%, 5%, 2% or 1%. This offers the advantage that during the overrun of the fluid pump, only little excess fluid comes up, which must then be discharged via the pressure-limiting valve.

The above-mentioned percent values are possible if one uses certain factors in the calculation. However, the invention is not restricted to fixed values. Depending on the stability and characteristic of the hydraulic system, there are different values. Preferably, however, the smallest possible value is used within the context of invention. This depends on the quality of the calculation, the constancy of the parameters of the hydraulic system and, here, in particular on the stiffness of the system, the reaction speed of the control unit and of the drive. Values below 5% are desirable.

In the preferred exemplary embodiment of the invention, the switch-off and/or the switch-on of the fluid pump resp. of the drive of the fluid pump are pressure-controlled. This means that the control unit measures the fluid pressure by means of the pressure sensor. The control unit then switches off the fluid pump during the pressure build-up when the measured fluid pressure exceeds the predefined switch-off pressure. Furthermore, the control unit can switch on the fluid pump again when the measured fluid pressure falls below the predefined switch-on pressure.

For specification of the switch-off pressure, it should be taken into account that the overrun pressure rise does not only depend on the inertia of the fluid pump and its drive, but rather also on the currently delivered and outflowing discharge flow. If, for example, a large discharge flow flows out via the consumer, the overrun pressure rise is only very low. For specification of the switch-off pressure, one therefore preferably takes into account the currently outflowing discharge flow of the fluid pump.

An option for determining the current discharge flow of the fluid pump consists in measuring the pump speed of the fluid pump or deriving it from the motor control, wherein the discharge flow can then be derived at least through approximation from the pump speed.

Another option for determining the current discharge flow of the fluid pump consists in the measurement by means of a volumetric flow sensor.

A further option provides for, in contrast, that the discharge flow of the fluid pump is assumed to be known.

The inertia of the system consisting of the fluid pump and its drive reflects during the operation in the temporal pressure change during the pressure build-up, i.e. in the first temporal derivative of the fluid pressure. Thus, a rapid pressure rise during the pressure build-up indicates a correspondingly high inertia and a high overrun pressure rise. One preferably measures therefore the temporal pressure change during the pressure build-up and takes it into account as a dimension for the inertia of the fluid pump.

It should also be mentioned that the switch-off pressure during the operation of the pressure medium system according to the invention is preferably adapted dynamically to the current operating state. This means that the switch-off pressure is continuously adapted to the actual operating state (e.g. rotational speed, fluid pressure, pressure rise, etc.).

For this dynamic adaptation of the switch-off pressure, the following marginal conditions resp. optimization goals are preferably taken into consideration:

- During the overrun, the fluid pressure should in any case rise up to the predefined target value.
- After the switching-off of the fluid pump, the predefined target value for the fluid pressure should be adjusted as fast as possible.
- During the overrun, as little as possible excess fluid should be delivered, which is not necessary for reaching the target value and must be discharged over the pressure-limiting valve.

In the preferred exemplary embodiment of the invention, the switch-off pressure is therefore calculated according to the following formula and continuously adapted during the operation:

$$P_{OFF}=P_{REQ}-(K1/P_{REQ}+K2)\cdot dP_{ACTUAL}/dt\cdot 1/Q$$

with:

$P_{OFF}$ Switch-off pressure.

$P_{REQ}$ Target value for the fluid pressure.

K1: Device-dependent constant, which reflects the inertia of fluid pump and drive motor.

K2: Device-dependent constant, which reflects the dead and delay times of the pump, motor and control unit.

$P_{ACTUAL}$ Current fluid pressure.

$dP_{ACTUAL}/dt$: Temporal pressure rise.

Q: Discharge flow of the fluid pump.

The invention is, however, with respect to the calculation of the switch-off pressure, not limited to the above-mentioned formula, but rather can fundamentally be realized also with other formulae for calculation of the switch-off pressure.

In a variant of the invention, the control unit is constructionally integrated into the pressure sensor and generates a switch-off signal for the motor control. It is, however, alternatively also possible that the control unit is constructionally separated from the pressure sensor and receives from the pressure sensor a pressure signal as an analog signal.

For a consumer, it can be required that the pressure is subsequently switched again, for example that a replenishment results along with the temporal delay or that a small leakage occurs or that the pressure can be reduced a little bit through strong cooling. Such subsequent switching pressure typically lies 5-10% below the predefined target value $P_{REQ}$, but above the switch-off pressure $P_{OFF}$. In this case, only a very small discharge rate is supplied in the system and needs further triggering when excess oil quantity should not be discharged via the pressure-limiting valve. For this case, the switching time of the drive motor of the fluid pump ("pressure motor") is reduced to such an extent that only the rotational speed is reached in order to achieve a smaller pressure build-up through overrun. This happens by reducing the constant K1 of the displacement volume Q and proportionally reducing the start-up time of the pump motor drive.

The term switching on and switching off of the fluid pump used within the context of the invention preferably gears to fully switching on and switching off the drive of the fluid pump. The invention also claims, however, protection for variants for which the drive of the fluid pump is merely run up or shut down.

In the preferred exemplary embodiment of the invention, the pressure medium system is a hydraulic system. The invention can, however, also be realized with other pressure medium systems, such as with pneumatic systems. It is merely decisive that the fluid pump still has an inertia-induced overrun after switching-off, while the fluid pressure still rises.

It should also be mentioned that the pressure medium system according to the invention preferably comprises a consumer, which is supplied with pressurized fluid. The consumer is preferably a clamping system for mechanical clamping of workpieces or workpiece holders such as workpiece pallets. Such clamping systems are per se known and described, for example in DE 31 36 177 A1, so that the content of this publication is to be included in full in the present description. The invention, however, also claims protection for pressure medium systems with other types of consumers.

Another aspect of the invention deals with the problem that the fluid pump has an inertia-induced pre-run during switching-on (subsequent switching), so that the fluid pressure does not yet rise substantially during the pre-run although the fluid pump is already switched on. The reasons for this pre-run are—as was already explained briefly at the beginning—on the one hand the dead time of the motor relay of the fluid pump and on the other hand the delayed pressure build-up in the pressure medium system.

The invention therefore also provides for that the control unit switches on the fluid pump again already at the drop of fluid pressure when the fluid pump is switched off before the fluid pressure has fallen to a predefined minimum pressure (e.g. 5% below the target pressure), which should not be fallen short of. The switch-on pressure (subsequent switching pressure) of the fluid pump is thus preferably greater than the predefined minimum pressure, which should not be fallen short of. This offers the advantage that the possibly occurring further pressure drop during the inertia-induced pre-run of the fluid pump does not cause that the predefined minimum pressure is fallen short of.

In a preferred exemplary embodiment of the invention, the control unit detects the temporal change of the fluid pressure by means of a pressure sensor when the fluid pump in the switched-off state. The switch-on pressure is then calculated by the control unit preferably depending on the temporal change of the fluid pressure, the fluid pump being switched off, the switch-off pressure and the predefined minimum pressure, wherein the calculation can be done according to the following formula:

$$P_{ON}=P_{MIN}-(k1+k2\cdot P_{OFF})\cdot dP_{ACTUAL}/dt$$

with:

k1, k2: Constants that characterize the pressure curve during start-up of the fluid pump for subsequent switching.

$P_{OFF}$ Switch-off pressure, which causes, taking into account the overrun during the run-up of the pressure, that the pressure target value $P_{REQ}$ is reached.

dP/dt: Temporal change of the fluid pressure after reaching the maximum value. Here, the slope is negative, so that the switch-on pressure $P_{ON}$ is greater than the predefined minimum pressure $P_{MIN}$.

The switch-on pressure (subsequent switching pressure) is thus preferably dimensioned such that the fluid pressure after switching on the fluid pump does not fall below the predefined minimum pressure during the pre-run of the fluid pump.

It should also be mentioned that the invention also comprises a corresponding operating method, as can already be seen from the above description.

Other advantageous developments of the invention are characterized in the subclaims or are explained in more detail below together with the description of the preferred exemplary embodiments of the invention on the basis of the figures. The figures show as follows:

DETAILED DESCRIPTION OF THE INVENTION

Figure 1:
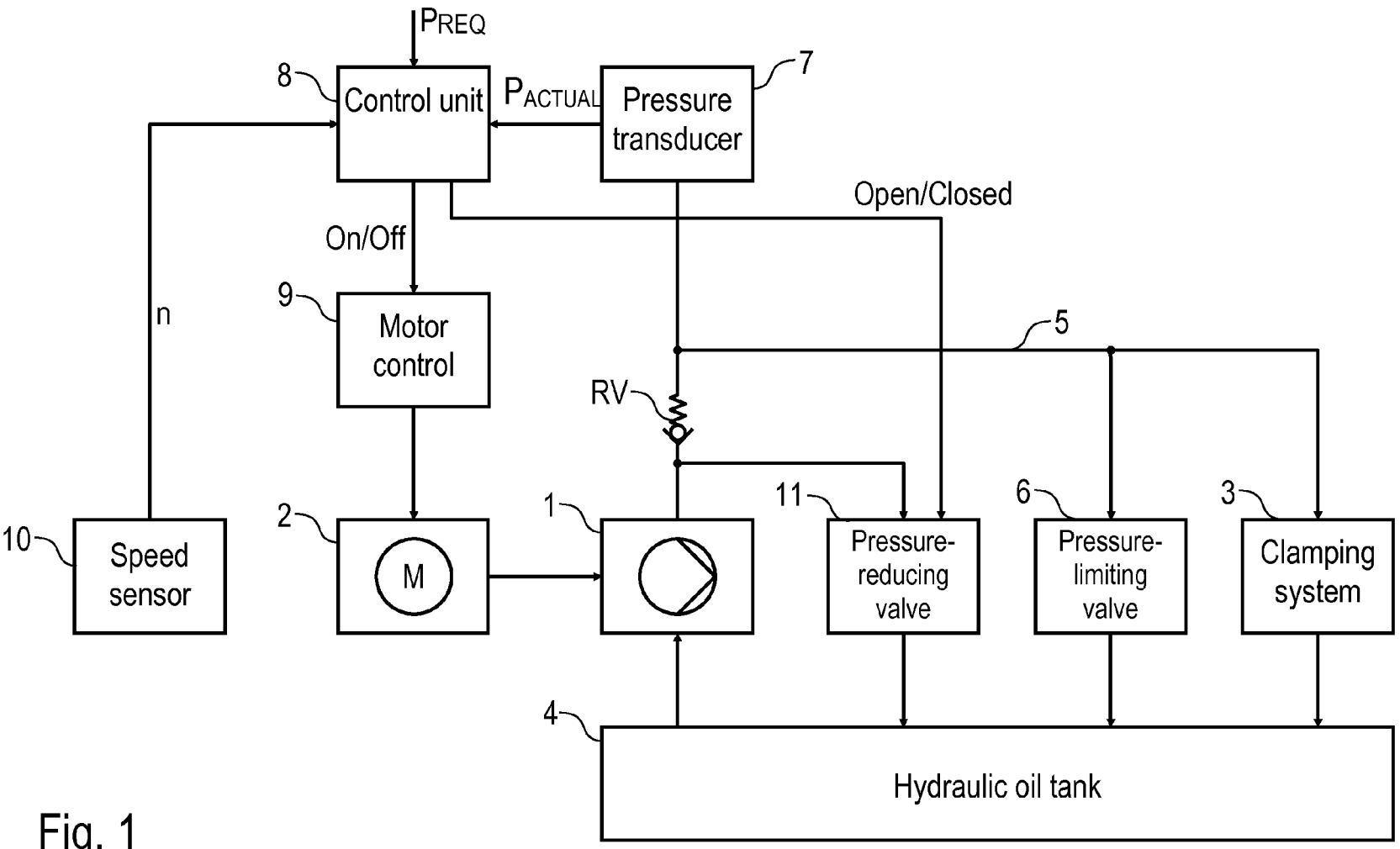
FIG. 1 a schematic representation of a hydraulic system according to the invention for hydraulic supply of a clamping device.

FIG. 1 shows a hydraulic system according to the invention having a hydraulic pump 1, which is driven by an electric motor 2, and supplies a mechanical clamping system 3 with the hydraulic pressure required for operation.

The hydraulic pump 1 is connected on the input side with a hydraulic oil tank 4 from which the hydraulic pump 1 extracts hydraulic oil and pumps via a back-pressure valve RV into a high-pressure area 5 to which the clamping system 3 is connected.

Furthermore, the hydraulic system has a pressure-limiting valve 6, which connects the high-pressure area 5 with the hydraulic oil tank 4. The pressure-limiting valve 6 is closed in the normal state and opens when the actual hydraulic pressure $P_{ACTUAL}$ in the high-pressure area 5 exceeds a predefined maximum value $P_{MAX}$.

Furthermore, the hydraulic system has a pressure sensor 7, which measures the actual hydraulic pressure $P_{ACTUAL}$ in the high-pressure area 5 and transmits it to a control unit 8, which triggers a motor control 9 depending on the measured hydraulic pressure $P_{ACTUAL}$, wherein the control unit 8 optionally switches on or switches off the electric motor 2.

For the triggering of the electric motor 2, the control unit 8 also takes into account the actual discharge flow Q of the hydraulic pump 1, since the actual discharge flow Q influences the overrun pressure rise. For this purpose, the control unit 8 is connected with a rotational speed sensor 10, which detects the rotational speed n of the electric motor 2 and thus also the pump speed. From the pump speed n, the control unit 8 calculates then the actual discharge flow Q of the hydraulic pump 1.

In addition, a pressure-reducing valve 11 is provided for, which branches off between the hydraulic pump 1 and the back-pressure valve RV and recycles hydraulic oil back, in the opened state, into the system oil tank 4, wherein the pressure-reducing valve 11 is controlled by the control unit 8. The control unit 8 opens the pressure-reducing valve 11 when the target value $P_{REQ}$ is decreased. This is meaningful so that the hydraulic pressure IS is reduced as fast as possible to the new, lower target value $P_{REQ}$.

The control unit 8 then continuously calculates during the operation (cf. step S1 in FIG. 2) a switch-off pressure $P_{OFF}$ according to the following formula:

$$P_{OFF}=P_{REQ}-(K1/P_{REQ}+K2)\cdot dP_{ACTUAL}/dt\cdot 1/Q$$

with:

$P_{OFF}$ Switch-off pressure.

$P_{REQ}$ Target value for the fluid pressure.

K1: Device-dependent constant, which reflects the inertia of fluid pump and drive motor.

K2: Device-dependent constant, which reflects the dead and delay times of the pump, motor and control unit.

$P_{ACTUAL}$ Current fluid pressure.

$dP_{ACTUAL}/dt$: Temporal pressure rise.

Q: Discharge flow of the fluid pump.

The device-specific constants K1, K2 can be determined previously in a calibration process.

Figure 2:
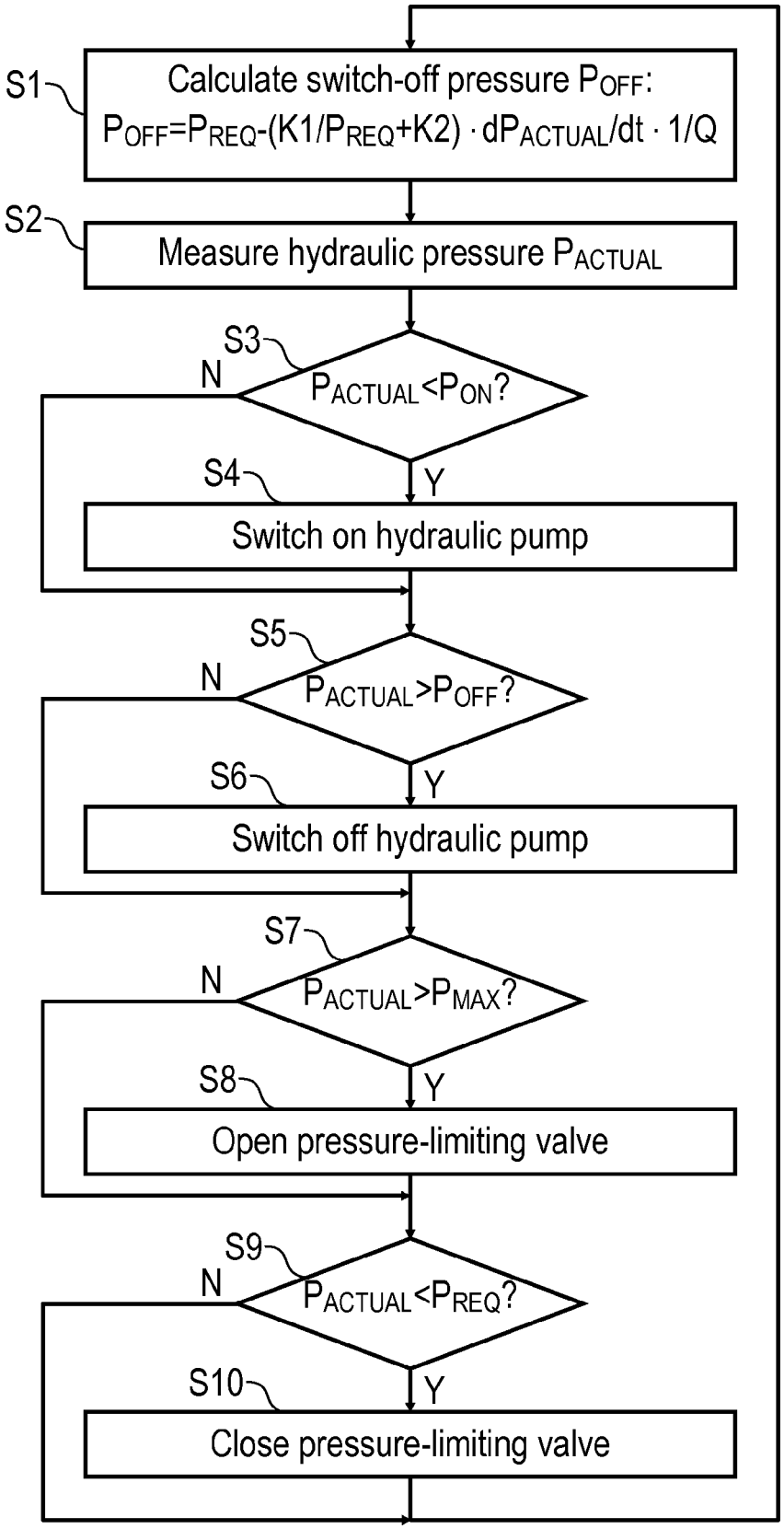
FIG. 2 the operating method of the hydraulic system from FIG. 1 in the form of a flow chart.

In the switched-off state of the hydraulic pump, the control unit 8 continuously measures by means of the pressure sensor 7 the hydraulic pressure $P_{ACTUAL}$ in the high-pressure area 5 (cf. step S2 in FIG. 2).

The control unit 8 then continuously checks whether the measured hydraulic pressure $P_{ACTUAL}$ falls below a predefined switch-on pressure $P_{ON}$ (cf. S3 in FIG. 2).

If this is the case, the control unit 8 sends a switch-on signal to the motor control 9, which then switches on the electric motor 2 in order to increase the hydraulic pressure (cf. step S4 in FIG. 2).

During the subsequent pressure build-up, the control unit 8 then continuously checks whether the actual hydraulic pressure $P_{ACTUAL}$ exceeds the switch-off pressure $P_{OFF}$ (cf. step S5).

If this is the case, the control unit 8 sends a switch-off signal to the motor control 9, which then switches off the electric motor 2 (cf. step S6).

During the subsequent inertia-induced overrun of the hydraulic pump 1, the hydraulic pressure $P_{ACTUAL}$ still rises in spite of the switched-off electric motor 2 due to inertia, wherein the overrun pressure rise $\Delta P_{OVERRUN}$ (cf. FIG. 3D) is sufficient in order to bypass the pressure difference ΔP between the switch-off pressure $P_{OFF}$ and the predefined target value $P_{REQ}$. During the overrun, the hydraulic pressure $P_{ACTUAL}$ therefore rises from the switch-off pressure $P_{OFF}$ up to the target value $P_{REQ}$.

During the overrun, the pressure-limiting valve 6 continuously checks whether the hydraulic pressure $P_{ACTUAL}$ exceeds a predefined maximum value $P_{MAX}$ (cf. step S7 in FIG. 2).

If this is the case, the pressure-limiting valve 6 opens automatically and conducts the excess hydraulic oil from the high-pressure area 5 into the hydraulic oil tank 4 back in order to prevent any further pressure rise beyond the maximum value $P_{MAX}$ (cf. step S8 in FIG. 2).

Furthermore, the pressure-limiting valve 6 continuously checks whether the hydraulic pressure has fallen below the predefined target value $P_{REQ}$ (cf. step S9 in FIG. 2).

If this were the case, the pressure-limiting valve 6 automatically closes in order to prevent any further flowing-out of hydraulic oil from the high-pressure area 5 in the hydraulic oil tank 4, since the hydraulic pressure $P_{ACTUAL}$ would thereby still fall below the predefined target value $P_{REQ}$ (cf. step S10 in FIG. 2).

Figure 3A:
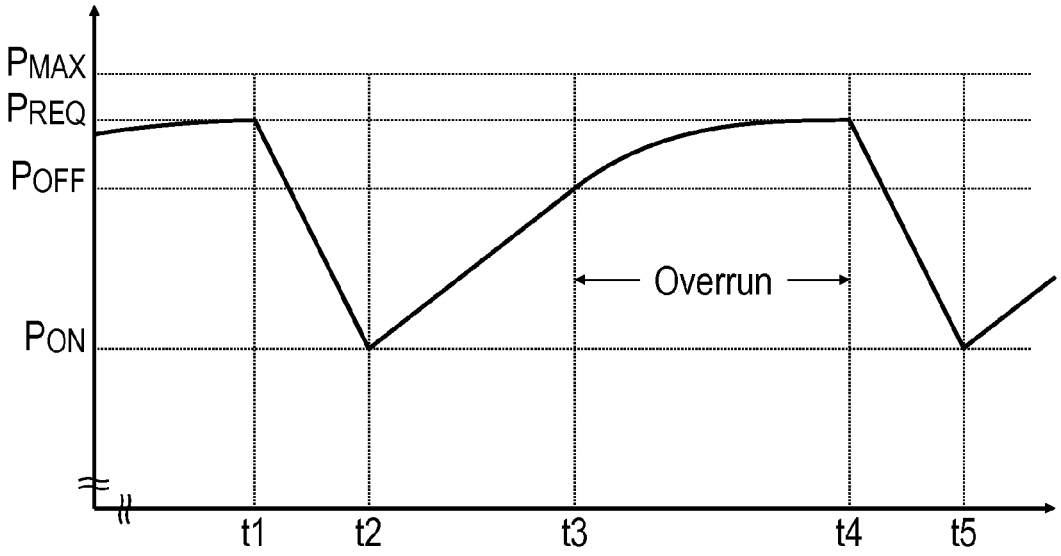
FIG. 3A the temporal course of the hydraulic pressure in the hydraulic system according to FIG. 1.
Figure 3B:
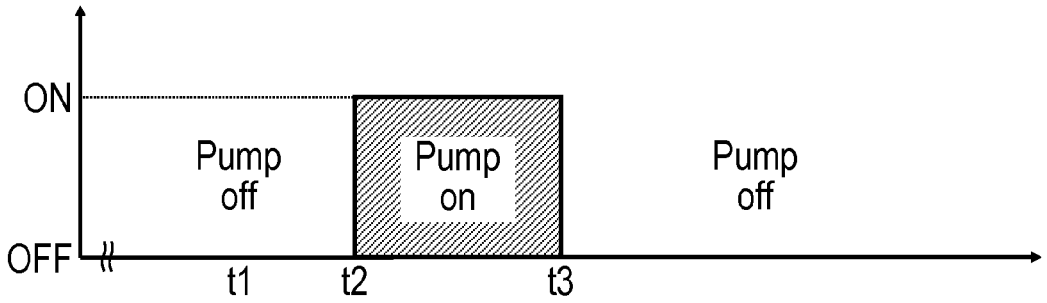
FIG. 3B the temporal course of the switch-on and switch-off state of the hydraulic pump.
Figure 3C:
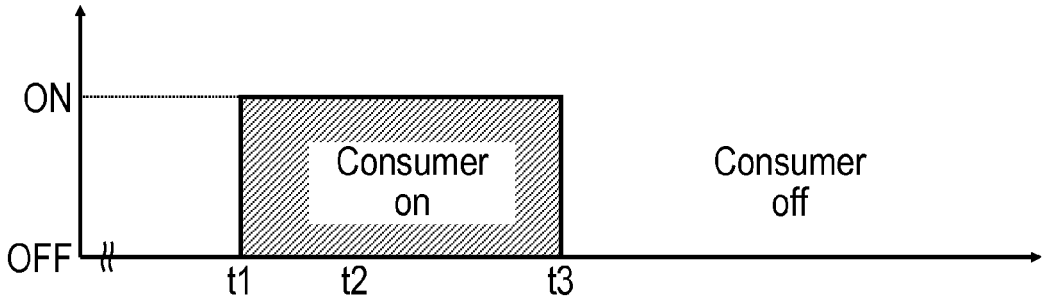
FIG. 3C the temporal course of the switch-on and switch-off state of the clamping system.
Figure 3D:
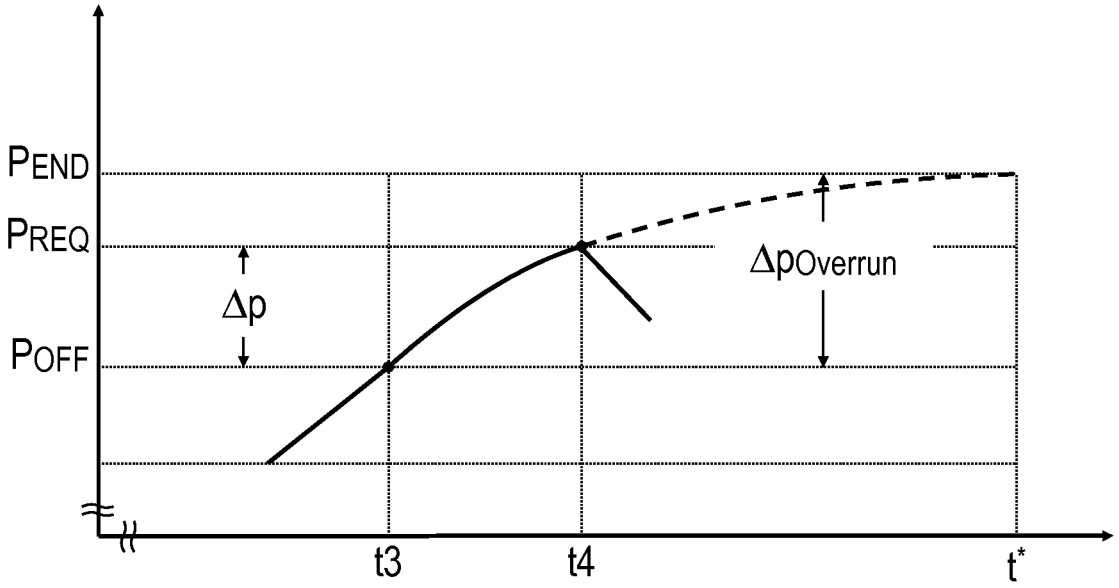
FIG. 3D an enlarged representation of the pressure curve during the overrun of the hydraulic pump.

It is further apparent from FIG. 3D that the maximum possible overrun pressure rise $\Delta P_{OVERRUN}$ without a pressure limitation is greater than the pressure difference ΔP between the switch-off pressure $P_{OFF}$ and the predefined target value $P_{REQ}$ to bypass. This is advantageous because the pressure rise during the overrun thereby occurs relatively quickly. However, this advantage goes along with the disadvantage that part of the hydraulic oil pumped during the overrun must be conducted via the pressure-limiting valve 6 back into the hydraulic oil tank 4.

Figure 4:
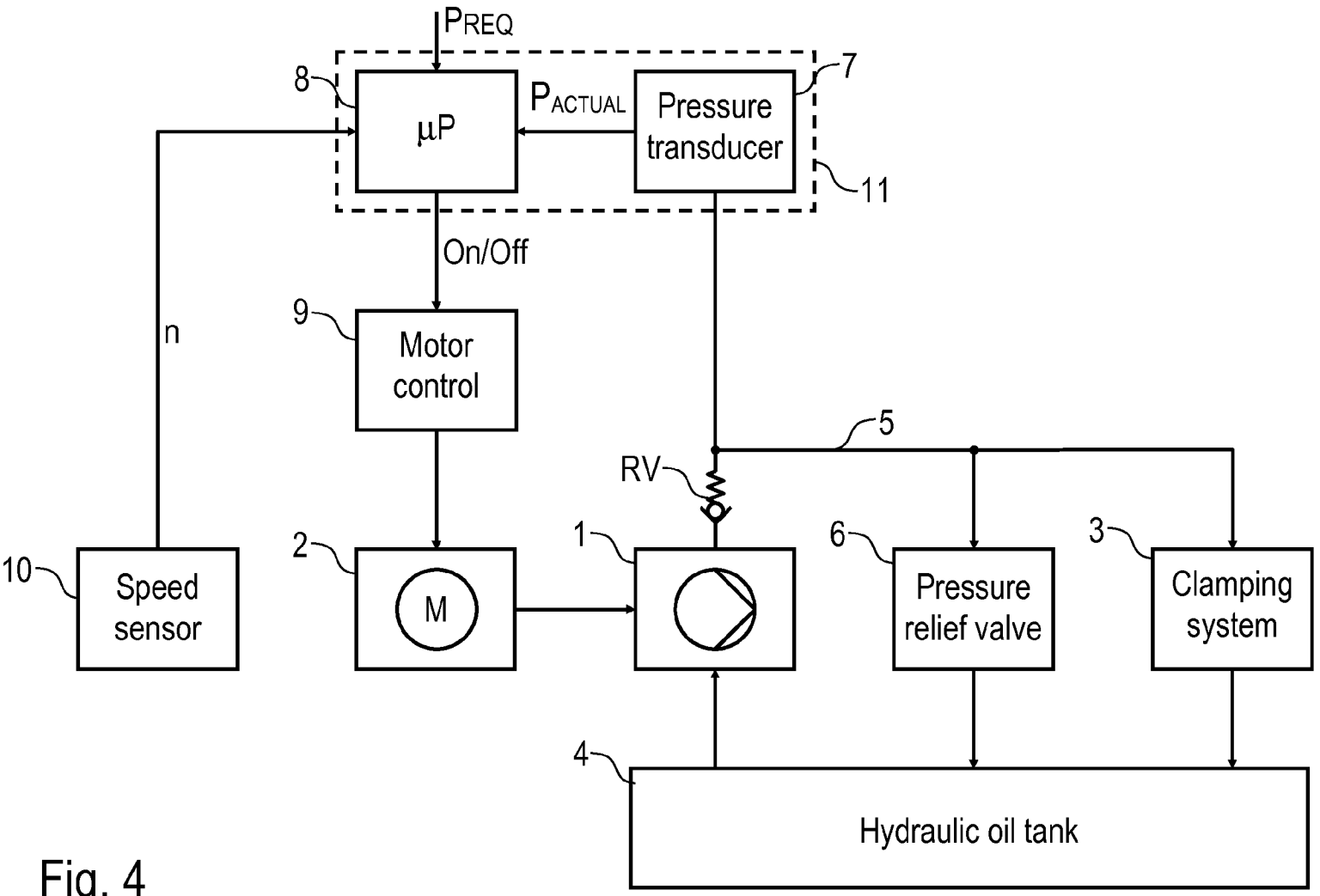
FIG. 4 a modification of the hydraulic system according to FIG. 1, wherein the control unit is integrated into the pressure sensor.
Figure 5A:
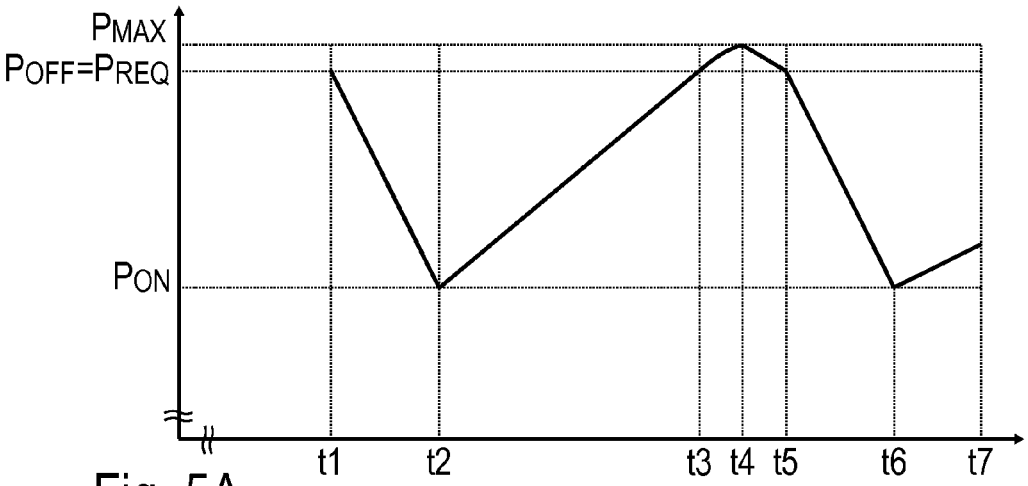
Fig. 5A Prior Art
FIG. 5A the temporal course of the hydraulic pressure in a conventional hydraulic system.
Figure 5B:
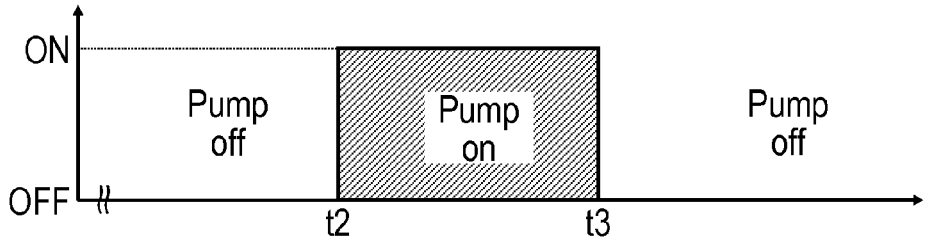
Fig. 5B Prior Art
FIG. 5B the temporal course of the switch-on and switch-off state of the hydraulic pump in the conventional hydraulic system.
Figure 5C:
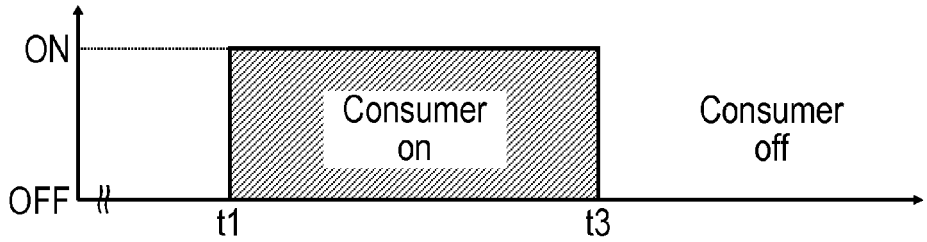
Fig. 5C Prior Art
FIG. 5C the temporal course of the switch-on and switch-off state of the clamping system in the conventional hydraulic system.
Figure 5D:
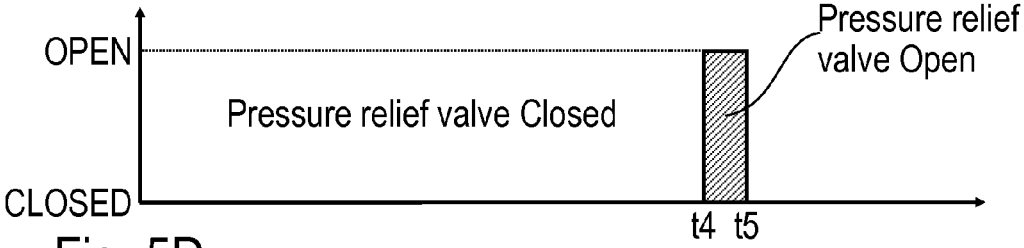
Fig. 5D Prior Art
FIG. 5D the temporal course of the switch-on and switch-off state of the pressure limiting valve in the conventional hydraulic system.

The exemplary embodiment in accordance with FIG. 4 largely corresponds with the exemplary embodiment according to FIG. 1 so that, to avoid repetition, reference is made to the above description with the same reference numbers being used for corresponding details.

A particularity of this exemplary embodiment consists in the fact that the control unit 8 is arranged in a common housing 11 with the pressure sensor 7.

Figure 6:
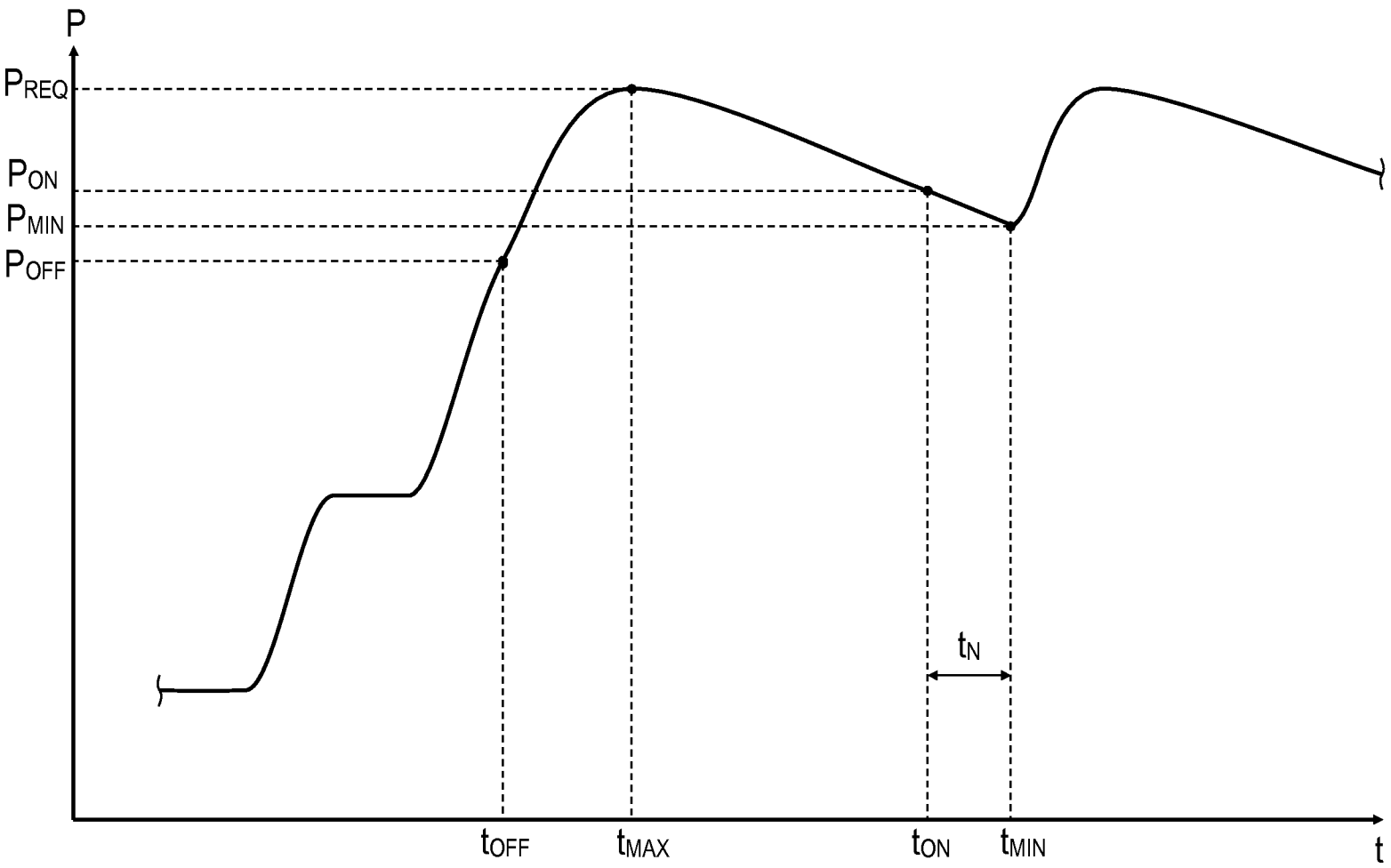
FIG. 6 the temporal course of the fluid pressure in a pressure medium system according to the invention, wherein the inertia-induced pre-run of the hydraulic pump is taken into consideration for the subsequent switching, as well as FIG. 7 a flow chart for clarifying the subsequent switching of the hydraulic pump for taking into account the inertia-induced pre-run of the hydraulic pump.
Figure 7:
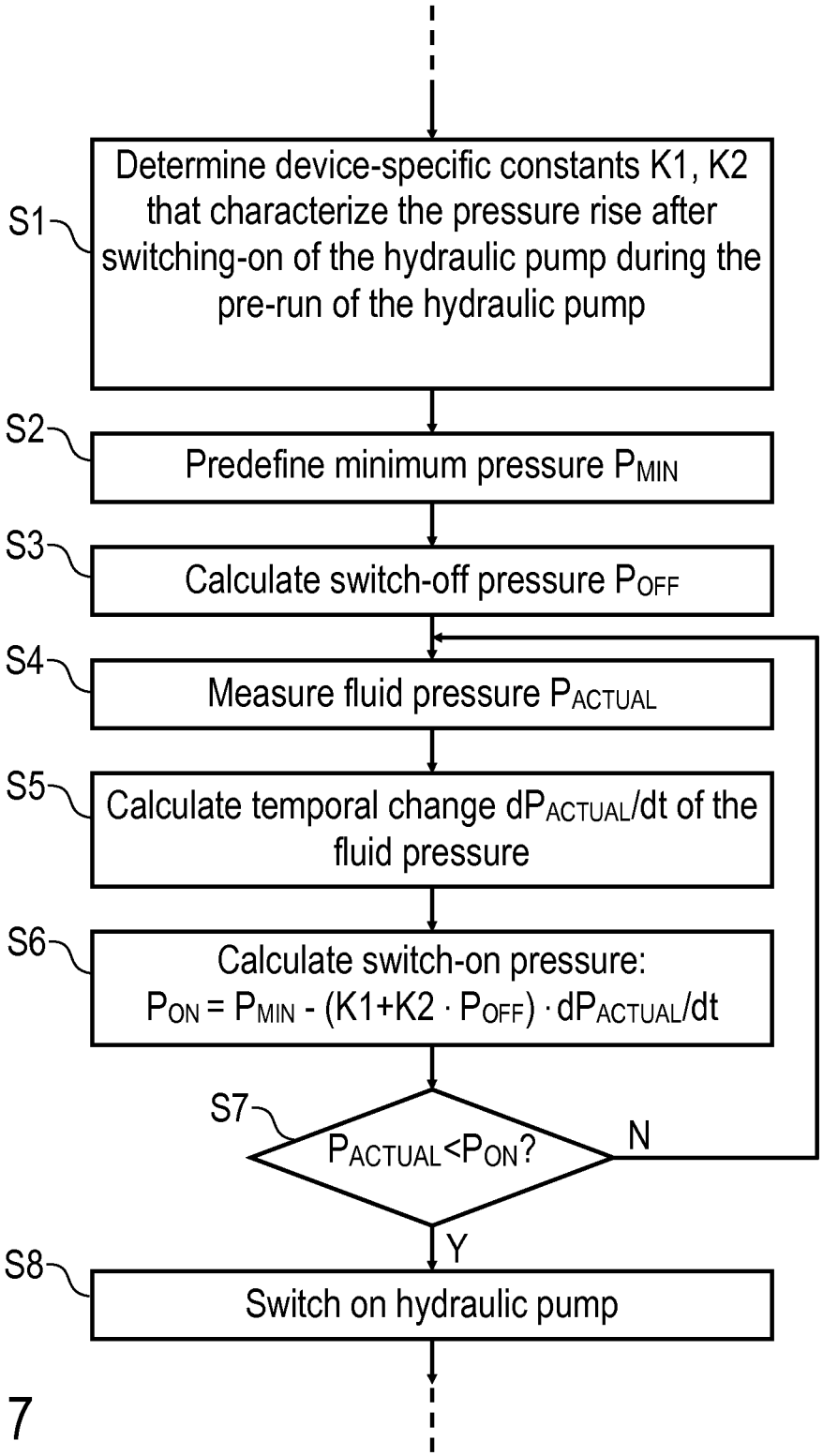

FIGS. 6 and 7 clearly show an aspect of the invention, which is directed at the problem of the inertia-induced temporal pre-run of the hydraulic pump 1. Thus, the hydraulic pressure $P_{ACTUAL}$ does not rise again immediately after switching-on (subsequent switching) of the hydraulic pump 1 at the time $t_{ON}$, since the pressure rise is delayed due to the dead time of the motor relay of the hydraulic pump 1 and also the pressure rise itself needs a certain pre-run. The invention therefore provides for in this aspect that the hydraulic pump 1 is already turned on again during the subsequent switching at a switch-on pressure $P_{ON}$, which is greater than the predefined minimum pressure $P_{MIN}$, so that the predefined minimum pressure $P_{MIN}$ is not fallen short of in spite of the inertia-induced pre-run of the hydraulic pump 1.

In a first step S1, device-specific constants K1, K2 that characterize the pressure rise after switching-on of the hydraulic pump 1 during the pre-run of the hydraulic pump 1 are determined.

In a further step S2, the minimum pressure $P_{MIN}$, which should not be fallen short of is predefined.

Furthermore, in a step S3, the switch-off pressure $P_{OFF}$, which leads to switching-off the hydraulic pump 1 during the run-up of the fluid pressure $P_{ACTUAL}$ is calculated. The calculation of the switch-off pressure $P_{OFF}$ was already explained in detail, so that, to avoid repetitions, reference is made in this respect to the preceding statements.

In a loop, the fluid pressure $P_{ACTUAL}$ is firstly measured in a step S4.

Furthermore, the temporal change $dP_{ACTUAL}/dt$ of the fluid pressure $P_{ACTUAL}$ is then calculated in the loop in a step S5.

In a further step S6, the switch-on pressure $P_{ON}$ is then calculated according to the following formula:

$$P_{ON}=P_{MIN}-(k1+k2\cdot P_{OFF})\cdot dP_{ACTUAL}/dt.$$

In a step S7, it is then checked in the loop whether the measured fluid pressure $P_{ACTUAL}$ falls below the calculated switch-on pressure $P_{ON}$. If this is the case, the hydraulic pump 1 is switched on in a step S8. Otherwise, the above-mentioned steps S4-S7 are repeated in a loop.

In this manner, it is ensured that the fluid pressure $P_{ACTUAL}$ will not fall below the predefined minimum pressure $P_{MIN}$, which should not be fallen short of, in spite of the inertia-induced pre-run of the hydraulic pump 1.

Subsequent switching in the suggested manner is advantageous because the kinetic energy of the pump-motor unit is exploited again and there is no pressure that is substantially higher than the target pressure. Thus, with such a device, a pressure value can be adjusted without too much oil volume having to be delivered by the pump, which would then have to be discharged again via a limiting valve.

In combination with the switching-off of the pump according to the invention already before reaching the target value $P_{REQ}$, a pressure adjusting system results for which the pressure-limiting valve 6 only serves for security purposes. The pressure setting is carried out through change of the target value $P_{REQ}$.

Through the use of the switch-off pressure $P_{OFF}$ from the initial pressure rise, some more energy is supplied to the hydraulic system, since the pressure must only be built up in the system consisting of the hydraulic pump 1 and the pressure tube and the whole hydraulic system is connected only after opening of the back-pressure valve RV.

The invention is not limited to the preferred exemplary embodiments described above. Instead, a plurality of variants and modifications are possible, which also make use of the concept of the invention and thus fall within the scope of protection. Furthermore, the invention also claims protection for the subject-matter and the features of the subclaims independently of the claims to which they refer.

LIST OF REFERENCE SIGNS

1 Hydraulic pump
2 Electric motor
3 Clamping system
4 Hydraulic oil tank
5 High-pressure range
6 Pressure-limiting valve
7 Pressure transducer
8 Control unit
9 Motor control
10 Speed sensor
11 Pressure-reducing valve
k1, k2 Constants that characterize the pressure curve during start-up of the fluid pump for downstream switching
K1 Device-dependent constant, which reflects the inertia of fluid pump and drive motor
K2 Device-dependent constant, which reflects the dead and delay times of the pump, motor and control unit
n Rotational speed of the electric motor
$P_{OFF}$ Switch-off pressure
$P_{ON}$ Switch-on pressure
$P_{ACTUAL}$ Hydraulic pressure
$P_{MIN}$ Minimum
$P_{MAX}$ Maximum pressure
$P_{REQ}$ Target value
ΔP Pressure difference between the shut-off pressure and the target value
$\Delta P_{OVERRUN}$ Overrun pressure rise
RV Non-return valve
Q Discharge flow of the hydraulic pump
$dP_{ACTUAL}/dt$ Temporal change of the hydraulic pressure

The invention claimed is:

1. A pressure medium system, with
a) a fluid pump for conveying a drive fluid with a certain discharge flow and a certain fluid pressure,
b) a control unit, which switches the fluid pump on or off to adjust a predefined target value of the fluid pressure,
c) wherein the fluid pump has an inertia-induced overrun during shut-off, so that the fluid pressure still rises during the overrun of the fluid pump, while the fluid pump is already switched off,
d) wherein the control unit switches off the fluid pump when increasing the fluid pressure to the predefined target value before the fluid pressure has reached the target value.

2. The pressure medium system according to claim 1, wherein
a) the fluid pressure still rises during the overrun after switching off of the fluid pump without any pressure limitation by a certain maximum possible overrun pressure rise, and
b) the control unit switches off the fluid pump when the fluid pressure exceeds a certain switch-off pressure.

3. The pressure medium system according to claim 2, wherein
a) the pressure difference between the predefined target value of the fluid pressure and the switch-off pressure is smaller than the maximum possible overrun pressure rise, so that the fluid pressure during the overrun still rises at least up to the predefined target value, and
b) the maximum possible overrun pressure rise exceeds the pressure difference between the predefined target value of the fluid pressure and the switch-off pressure by at least 10%, 20%, 50%, 100% or 200%, and
c) the maximum possible overrun pressure rise exceeds the pressure difference between the predefined target value of the fluid pressure and the switch-off pressure by at most 200%, 100%, 50%, 20% or 10%.

4. The pressure medium system according to claim 3, wherein
a) the fluid pump is driven by a drive motor,
b) the drive motor is controlled by a motor control unit,
c) the control unit transmits a switch-off signal to the motor control unit for switching off the fluid pump.

5. The pressure medium system according to claim 1, wherein
a) a pressure sensor is provided, which measures the fluid pressure and forwards the measured fluid pressure to the control unit, and
b) the control unit switches off the fluid pump depending on the measured fluid pressure and
c) the control unit switches on the fluid pump depending on the measured fluid pressure and d) the control unit switches off the fluid pump when the measured fluid pressure exceeds a certain switch-off pressure, and e) the control unit switches on the fluid pump when the measured fluid pressure falls below a certain switch-on pressure.

6. The pressure medium system according to claim 5, wherein a) the control unit determines the discharge flow of the fluid pump, b) the control unit determines the switch-off pressure depending on the discharge flow of the fluid pump and the predefined target value of the fluid pressure.

7. The pressure medium system according to claim 6, wherein a) the fluid pump is driven by a drive motor with a certain rotational speed, and b) the control unit calculates the discharge flow of the fluid pump from the rotational speed of the drive pump.

8. The pressure medium system according to claim 5, wherein the control unit adapts the switch-off pressure dynamically during operation depending on at least one of the following values:

the discharge flow of the fluid pump, the predefined target value for the fluid pressure, the temporal pressure rise of the fluid pressure.

9. The pressure medium system according to claim 1, wherein a) the drive fluid is a hydraulic fluid, and that the fluid pump is a hydraulic pump, and b) the fluid pump supplies a consumer with the drive fluid, and c) the consumer is a mechanical clamping system, which clamps a workpiece or a workpiece holder detachably.

10. The pressure medium system according to claim 6 or claim 9, wherein a) the control unit determines the temporal change of the fluid pressure when the fluid pump is in the switched-off state, via the pressure sensor, and b) the control unit determines the switch-on pressure depending on at least one of the following values:

the temporal change of the fluid pressure when the fluid pump is in the switched-off state, the switch-off pressure, the predefined minimum pressure.

11. The pressure medium system according to claim 10, wherein a) the switch-on pressure is greater than the predefined minimum pressure, and b) the switch-on pressure is preferably dimensioned such that the fluid pressure after switching on the fluid pump does not fall below the predefined minimum pressure during the pre-run of the fluid pump.

12. An operating method for a pressure medium system having a) a fluid pump for conveying a drive fluid with a certain discharge flow and a certain fluid pressure, b) a control unit, which switches the fluid pump on or off to adjust a predefined target value of the fluid pressure, c) wherein the fluid pump has an inertia-induced overrun during shut-off, so that the fluid pressure still rises during the overrun of the fluid pump, while the fluid pump is already switched off, d) wherein the control unit switches off the fluid pump when increasing the fluid pressure to the predefined target value before the fluid pressure has reached the target value.

13. A pressure medium system, comprising:

a) a fluid pump for conveying a drive fluid with a certain discharge flow and a certain fluid pressure;

b) a control unit, said control unit switches the fluid pump on or off to adjust a predefined target value of the fluid pressure;

c) wherein the fluid pump has an inertia-induced pre-run during switching-on so that the fluid pressure does not substantially rise during the pre-run of the fluid pump while the fluid pump is already switched on, and d) wherein the control unit switches the fluid pump on at the drop of fluid pressure if the fluid pump is switched off before the fluid pressure has fallen to a predefined minimum pressure.

* * * * *